US007819446B2

(12) United States Patent
Glynn

(10) Patent No.: US 7,819,446 B2
(45) Date of Patent: Oct. 26, 2010

(54) DEVICE FOR PICKING UP SOLID MATERIAL WITHIN A FLEXIBLE BAG

(76) Inventor: Maurice Joseph Glynn, Rose Cottage, 94 Marsh Lane, Preston (GB) PR4 5ZL ( * ) Notice: Subject to any disclaimer, the term of this patent is extended or adjusted under 35 U.S.C. 154(b) by 327 days.

(21) Appl. No.: 12/060,797

(22) Filed: Apr. 1, 2008

(65) Prior Publication Data

US 2009/0243316 A1 Oct. 1, 2009

(51) Int. Cl.
*A01K 29/00* (2006.01)

(52) U.S. Cl. ..... 294/1.3

(58) Field of Classification Search ..... 294/1.3, 294/1.4, 1.5

See application file for complete search history.

(56) References Cited

U.S. PATENT DOCUMENTS 4,253,691 A * 3/1981 Liu ..... 294/1.4
4,286,816 A * 9/1981 Tobias ..... 294/1.4
7,080,863 B2 7/2006 Cappellano et al.

FOREIGN PATENT DOCUMENTS

GB 2355389 A 4/2001
WO 93/20285 A1 10/1993

* cited by examiner

*Primary Examiner*—Paul T Chin
(74) *Attorney, Agent, or Firm*—Janet Sleath; Speckman Law Group PLLC

(57) ABSTRACT

A device for picking up solid material within a flexible bag is provided. The disclosed device comprises an outer body; an inner body substantially and slidably enclosed by the outer body; at least one spring mounted between the outer body and the inner body, wherein the inner and outer bodies each comprises an open end, wherein the inner body comprises an edge margin which is slidably protrudable from the open end of the outer body, wherein an elastic band is stretchably fittable around the protruding edge margin, wherein the outer body can be pushed downwards over the protruding edge margin of the inner body, causing the elastic band to be dislodged from the edge margin of the inner body.

10 Claims, 2 Drawing Sheets

DEVICE FOR PICKING UP SOLID MATERIAL WITHIN A FLEXIBLE BAG

FIELD OF THE INVENTION

This invention relates to devices for hygienically and efficiently picking up solid material, such as dog feces, within a flexible bag from various surfaces.

BACKGROUND OF THE INVENTION

Several types of scoop devices for hygienically and efficiently picking up unpleasant materials, such as dog feces, from various surfaces are known. These scoop devices tend to be bulky and awkward to use. Thus, most pet owners simply place their hands in a plastic bag and collect the feces with their hands and fingers.

U.S. Pat. No. 7,080,863 discloses an apparatus for picking up an object. The apparatus is provided with an elongated handle having a lower end carrying a downwardly open bell. A tubular body inside the bell has a lower edge and can move between a lower position with the edge projecting downward past a lower bell edge and an upper position. A downwardly open bag has a closed upper end releasably retained inside the tubular body and an open end lying against an outer surface of the lower body edge. An elastic annular element engages around the body and the bag immediately above the tapered lower body edge and holds the bag against the outer surface of the lower end of the tubular body. Upward displacement of the tubular body into the upper position causes the lower bell edge to downwardly engage and push the elastic annular element downward off the tubular body.

GB 2355389 discloses a device for picking up excrement. The device comprises a holder for at least one bag which is open at one extremity, and means which is movable over the holder for pushing an elastic band, provided around the open extremity, partially away from the holder, causing the elastic band to relax and close around the bag. The holder and the movable means comprises two tubular elements, which can be pushed and slide over each other and placed over the excretions, the open extremity of the inner tubular element protruding from the outer element and being surrounded by an elastic band, and a bag being folded back with its edges over the band and the open extremity. A spring may be provided between the tubular elements which returns the device to its original position. The extremity of the inner element may either be inclined and the extreme edge may be lying in a plane which forms an angle with the longitudinal axis of the tubular elements, or may have two protrusions situated opposite to each other. These arrangements cause the band to be released first from a part of the extremity and snapping tight around the bag. Several bags may be stored in the upper portion of the inner element and a lid may be provided.

However, the devices disclosed above are limited. In particular, in the device described in U.S. Pat. No. 7,080,863, the contraction of the elastic band as it is dislodged is not likely to be sufficient to fully close the bag. There may also be problems in reliably dislodging the elastic band from the protruding edge margin of the inner body, more so if the elastic band is tightly stretched around the protruding edge margin. Thus, there remains a need to provide a device that is effective in closing a bag around solid materials, has a relatively simple structure and is cost-effective to manufacture.

SUMMARY OF THE INVENTION

A device for picking up solid material within a flexible bag is provided. In one embodiment, the device comprises a substantially rigid container for use with an elastic band, or a ligature and a flexible bag. The container is provided with an open end, over which the flexible bag, when in use, is fitted. The container comprises an inner tubular body slidably retained within an outer tubular body. The inner tubular body has an edge margin which, in a condition ready for use of the device, protrudes from the open end of the outer tubular body with the ligature stretched around the protruding edge margin. The outer tubular body can be pushed over the protruding edge margin of the inner tubular body to dislodge the ligature, so that when a flexible bag is fitted over the open end of the container and is deformed inwardly of the container, dislodgement of the ligature serves to close the flexible bag around the solid materials to be picked up.

At least one guiding system for the ligature is provided on the outer body of the container. In one embodiment, the at least one guiding system comprises a first guide element and a second guide element, and is provided on the outer body of the container. The first guide element is provided adjacent the open end of the container, and the second guide element projects from the outer body and away from the open end of the container. The first and second guide elements are configured and arranged so that a ligature can be guided by way of the first guide element and guided around the second guide element, allowing tension to be added to the ligature prior to its dislodgement. The first and second guide elements also serve to keep the flexible bag and any solid material enclosed therein connected to the container after closure of the bag by the ligature.

In one embodiment, the first guide element comprises at least one pair of guiding lugs, which projects from the outer body, defining a guiding slot there between. The second guide element also comprises at least one pair of guiding lugs. The guiding lugs are secured to or formed on the exterior of the outer body and may be in the form of a button, a stud, a lug, a hook, a clip, and the like.

In one embodiment, a notch is provided in the edge margin of the inner body, at the open end thereof and in the vicinity of the first guide element of the outer body. The notch can be used to hold the flexible bags containing the solid material towards the inside of the container once it is closed off by the ligature entrained around the guide elements.

In another embodiment, the device for picking up solid material within a flexible bag comprises additional guide elements positioned on the outer body in order to provide tension and attachments to containers having a plurality of successive ligatures and flexible bags closed thereby. In this embodiment, the device can pick up excess material, such as several successive mounds of feces, while keeping the respective bags connected to the container until they can all be disposed. This embodiment is particularly useful for users walking more than one dog.

In order to reduce contact between the ligature and the inner body, a plurality of spacers may be advantageously provided on the inner body, or at least on the protruding edge margin thereof. The spacers can facilitate dislodgement of the ligature from the inner body margin by the relative movement of the outer body and can prevent the ligature from being trapped between the outer and inner bodies.

In one embodiment, each spacer comprises a radially and longitudinally extending rib, having a radiused outer surface. The spacers are spaced apart at substantially equal intervals around the edge margin of the inner body. In another embodiment, a plurality of spaced-apart longitudinal grooves is provided on the inner body to assist the release of the ligature.

In this embodiment, at least one spring is provided between the inner and outer tubular bodies of the container, allowing the inner body to protrude by its edge margin out of the open end of the outer body.

In another embodiment, a handle is provided on the outer body. In yet another embodiment, a lid for closing the open end of the container may be provided. The lid is useful for storing elastic ligatures and bags therein prior to use. The lid also allows temporary storage and holding of bags containing gathered solid material in the interior of the container.

BRIEF DESCRIPTION OF THE DRAWINGS

The disclosed invention will be described in greater detail in the following detailed description, with reference to the accompanying drawings, wherein.

DETAILED DESCRIPTION OF THE INVENTION

Figure 1:
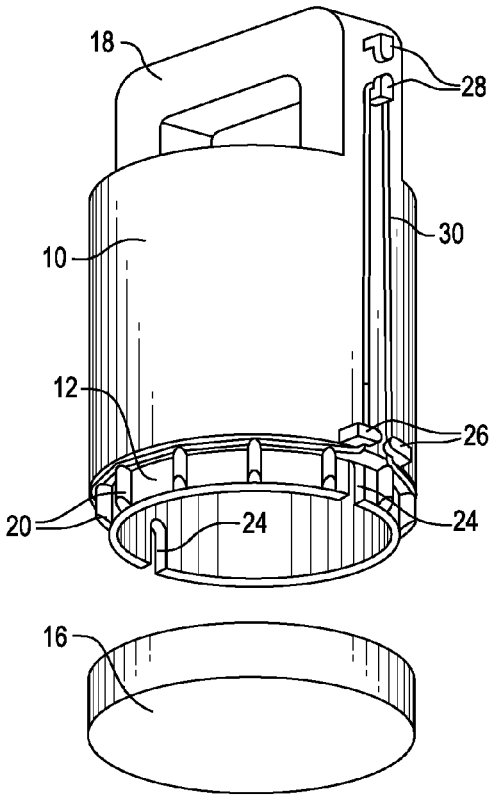
FIG. 1 is a perspective view of an embodiment of a device for picking up solid materials within a flexible bag, showing a lid attachable to the device and a ligature fitted thereto.
Figure 3:
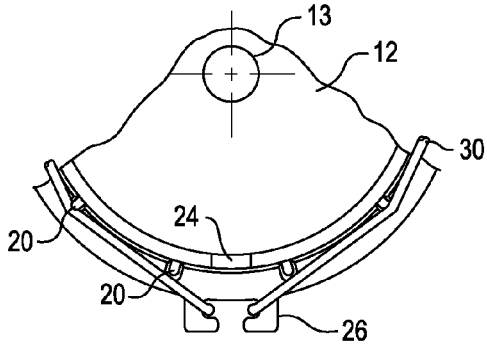
FIG. 3 illustrates a partial bottom view of the device as shown in FIG. 1, with the lid removed and a ligature fitted.
Figure 2:
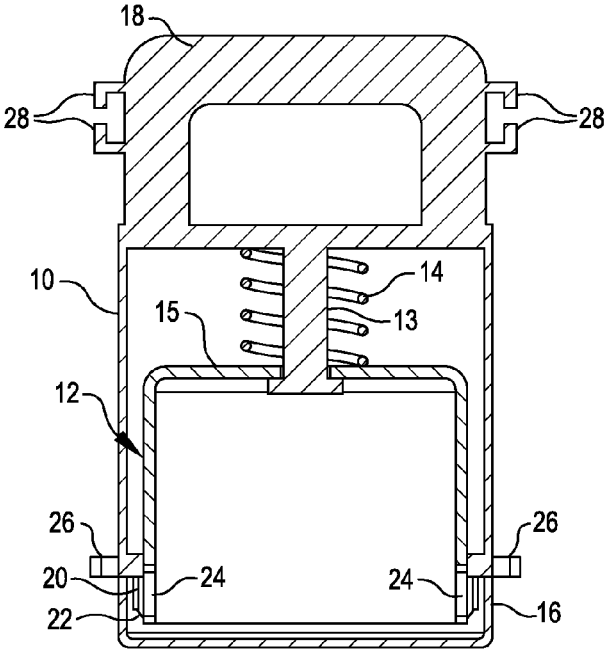
FIG. 2 is a longitudinal cross-sectional view of the device as shown in FIG. 1.

FIGS. 1 and 2 show an embodiment of a device for picking up solid materials within a flexible bag. In this embodiment, the device comprises an outer body 10, an inner body 12 slidably and substantially enclosed by the outer body 10, and a spring 14. The inner body 10, the outer body 12, and the spring 14 define an open ended container. The disclosed device may be provided with a lid 16 fittable over the inner body 12.

The outer body 10 is in the form of a substantially rigid housing of a generally tubular configuration, being open at one end and being provided with a handle 18 at the other end, which is closed. The inner body 12 also has a generally tubular configuration, provided with an open end and a base wall 15. As shown in FIG. 2, the inner body 12 has a shorter length than that of the outer body 10, and is mounted inside the outer body 10 in a spring loaded manner, so that an open end margin of inner body 12 protrudes from the open end of the outer body 10. The base wall 15 of the inner body 12 is retained on an axial spigot 13 in the interior of the outer body 10. The spring 14 has a helical configuration, and is mounted around the spigot 13 to act between the interior of the inner body 10 and the base wall 15 of the inner body 12.

When the open end of the device, formed by the inner and outer bodies 10 and 12, is placed against a surface and downward pressure is applied on the outer body 10, the inner body 12 slides upwardly inside the outer body 10 against the force of spring 14 for a distance corresponding to the original protruding edge margin of the inner body 12.

The inner body 12 is not a close fit inside the outer body 10. A small annular gap remains between the inner body 12 and the outer body 10, and the inner body 12 is provided around its protruding edge margin with a plurality of spacers 20 in the form of spaced-apart longitudinally extending ribs having radiused outer surfaces. The outer edge of the inner body 12 is also provided with at least one chamfer 22. The spacers 20 and the chamfer 22 facilitate removal of a ligature 30 from the disclosed device as described below.

Two notches, or longitudinal slots 24 are provided at opposing locations at the protruding edge of the inner body 12.

The device has two guiding systems, which are positioned on its outer body 10. Each guiding system comprises a first guide element 26 adjacent the open end of the outer body 10, and a second guide element 28 positioned at a distance apart from the first guide element 26, on the side of handle 18. The position of the first guide element 26 corresponds with the position of one of the notches 24 formed on the inner body 12. The first guide element 26 comprises a pair of facing hook-like lugs. The second guide element 28, in this embodiment, also comprises a pair of facing hook-like lugs, but arranged in a manner perpendicular to the lugs forming the first guide element 26.

In operation, a large, strong elastic band, or a ligature 30 is placed around the spacers 20 at the protruding edge margin of the inner body 12. The ligature 30 is guided between one of the lugs of the first guide element 26, and then stretched up to be looped around one of the lugs of the associated second guide element 28, whereby ligature 30 is held in tension.

Figure 4:
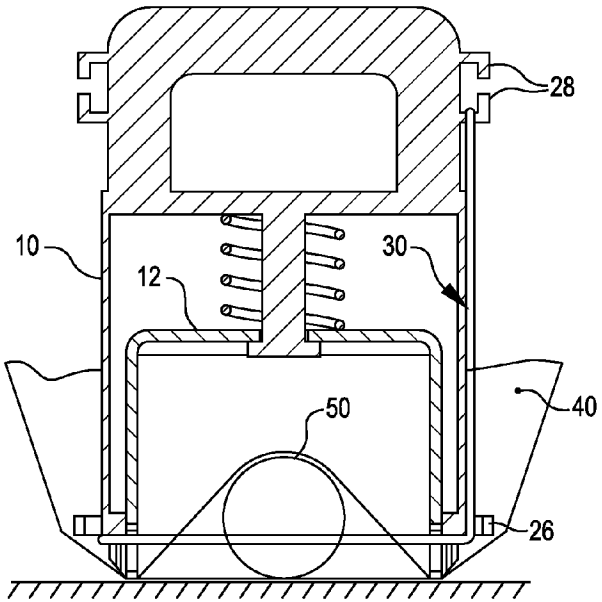
FIG. 4 illustrates a longitudinal cross-sectional view of the device as shown in FIG. 2, with the device placed over a solid material.

As shown in FIG. 4, a flexible bag 40, such as a conventional polythene bag, is fittable over the open ends of the inner and outer bodies 10, 12. The device can then be placed over solid material 50, such as dog feces, to be collected into the bag 40. The solid material deforms the bag 40 inwardly of the inner body 12.

Figure 5:
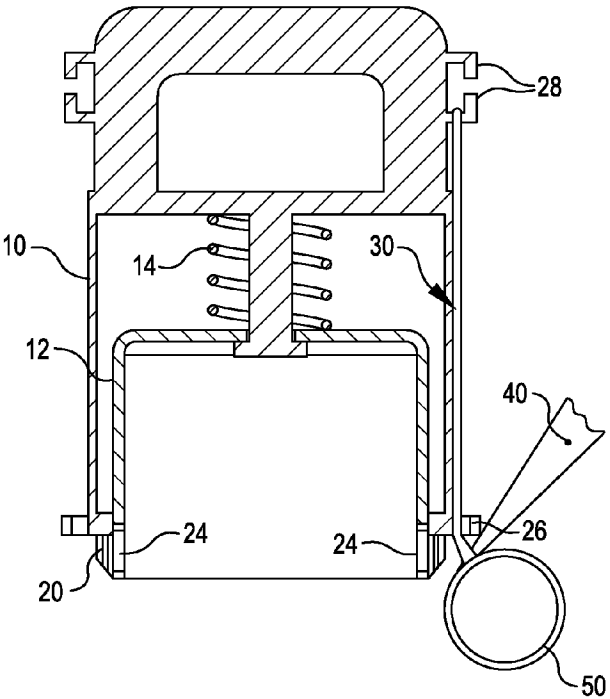
FIG. 5 illustrates a longitudinal cross-sectional view of the device as shown in FIG. 4, showing the solid material being collected by a bag.

Pressure is then applied downwards onto the top of the outer body 10 by way of handle 18. The applied pressure causes the outer body 10 to slide down over the inner body 12, as the inner body 12 is retracted into the outer body 10 against the action of the spring 14. This causes the edge of the outer body 10 to dislodge the ligature 30 from around the previously protruding edge margin of the inner body 12. As tension is released from ligature 30, it drags the bag 40 under the solid material 50, thereby collecting the solid material 50 within bag 40, as shown in FIG. 5. The bag 40 containing the solid material 50 is, however, still attached to the outer and inner bodies 10 and 12 by way of the ligature 30, which is still entrained around the first and second guide elements 26 and 28, albeit under reduced tension.

Figure 6:
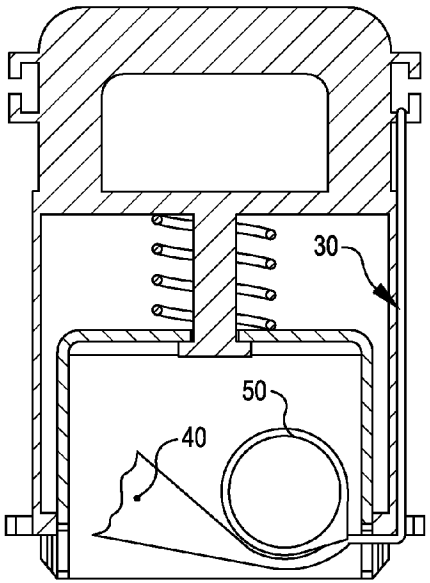
FIG. 6 illustrates a longitudinal cross-sectional view of the device as shown in FIG. 4, showing the bag holding the solid material stored within the device.

As the device is lifted from the surface or the ground, the bag 40 containing the solid material 50 is suspended from the first guide element 26. The edge of the inner body 12 protrudes again under the action of the spring 14 and a neck portion of the bag 40 can be engaged through the adjacent notch 24 in the protruding edge margin so that the bag 40 and the solid material 50 contained within are held inside the device, as shown in FIG. 6. The bag 40 containing the solid material 50 can be temporarily stored in the interior of the inner body 12 in this manner and the lid 16 can be applied and closed, as shown in FIG. 2.

The bag 40 containing the solid material 50 can be removed from the device by unhooking the ligature 30 from the first and second guide elements 26 and 28 and be disposed. The ligature 30 may be disposed or reused.

The disclosed device of the invention, as exemplified by the illustrated figures, is more advantageous and effective than known devices because of the provision of additional tensioning to the ligature 30 by way of the first and second guide elements 26 and 28.

The second set of the guiding system, comprising a third guide element, a fourth guide element, and an additional notch in the edge margin of the inner body 12 at a different location from the first and second guide elements 26 and 28, allowing the device to be used consecutively with a second ligature and a second flexible bag while the first ligature 30 and bag 40 containing a previously collected solid material are still connected to the device. The first bag 40 and second bag can then be disposed at the same time. The two guiding systems are particularly useful where a user needs to pick up more than one mass of solid materials during an outing or when more than one dog is being walked.

In other embodiments, the form of the guiding systems may vary. For example, the second guide element 28 may be in the form of a single hook, a button, a clip, or any other suitable formation about which the ligature 30 can be guided for tensioning purposes.

While certain embodiments of the present invention have been described, it will be understood that various changes could be made in the above constructions without departing from the scope of the invention. It is intended that all matter contained in the above description or shown in the accompanying drawings shall be interpreted as illustrative and not in a limiting sense.

I claim:

1. A device for picking up solid material within a flexible bag, comprising:

(a) an outer body;

(b) an inner body substantially and slidably enclosed by the outer body; and (c) a first guide element and a second guide element positioned on the exterior of the outer body, wherein the inner and outer bodies each comprise an open end, wherein the inner body comprises an edge margin which is slidably protrudable from the open end of the outer body, wherein an elastic band is stretchably fittable around the protruding edge margin, wherein the flexible bag can be fitted over the protruding edge margin, wherein the outer body can be pushed downwards over the protruding edge margin of the inner body, causing the elastic band to be dislodged from the edge margin of the inner body, closing the flexible bag around the solid material, wherein the first guide element is adjacent the open end of the outer body, wherein the second guide element projects away from the outer body and is spaced apart from the open end of the outer body, wherein the elastic band can be attached to the device by way of the first and second guide elements, whereby guidance and tension is provided to the elastic band, and the flexible bag remains connected to the device after the flexible bag is closed.

2. The device of claim 1, additionally comprising at least one spring mounted between the outer body and the inner body, wherein the inner body comprises a base wall retained on an axial spigot attached to the interior of the outer body, and the at least one spring is mounted around the spigot to act between the interior of the inner body and the base wall of the inner body.

3. The device of claim 1, additionally comprising a lid removably fittable over the edge margin of the inner body.

4. The device of claim 1, wherein the first guide element comprises a pair of guide lugs, defining a guide slot there between.

5. The device of claim 1, wherein the second guide element is in the form of a button, a stud, a lug, a hook, a clip, and is secured to or formed on the exterior of the outer body.

6. The device of claim 1, wherein at least one notch is provided in the edge margin of the inner body in proximity to the first guide element.

7. The device of claim 1, wherein at least two notches are provided in the edge margin of the inner body.

8. The device of claim 1, wherein the inner body comprises a plurality of spacers positioned to reduce contact between the elastic band and the inner body.

9. The device of claim 8, wherein the plurality of spacers comprises longitudinally extending ribs spaced apart around the exterior of the inner body.

10. The device of claim 1, comprising a handle provided on the outer body.

* * * * *